United States Patent [19]

Boyack

[11] 4,407,102

[45] Oct. 4, 1983

[54] CONCRETE AND RESIN SWIMMING POOL WALL

[76] Inventor: John D. Boyack, 5340 Ridge Rd. West, Spencerport, N.Y. 14559

[21] Appl. No.: 244,106

[22] Filed: Mar. 16, 1981

[51] Int. Cl.[3] ..... E02D 27/34; E04B 1/98; E04H 9/02

[52] U.S. Cl. ..... 52/169.7; 52/169.8; 52/249; 52/309.12; 52/404; 52/407; 52/426; 4/506

[58] Field of Search ..... 52/169.7, 169.8, 426, 52/249, 404, 407, 309.12; 4/488, 506

[56] References Cited

U.S. PATENT DOCUMENTS

| | | | |
|---|---|---|---|
| 2,251,499 | 8/1941 | Pelton | 52/422 |
| 3,238,684 | 3/1966 | Wood | 52/481 |
| 3,371,455 | 3/1968 | Fox | 52/169.8 |
| 3,396,500 | 8/1968 | Lanrheet | 52/169.7 |
| 3,440,780 | 4/1969 | Adam et al. | 52/169.7 |
| 3,468,088 | 9/1969 | Miller | 52/426 |
| 3,487,599 | 1/1970 | Jansen | 52/169.8 |
| 3,555,751 | 1/1971 | Thorgusen | 52/127.3 |
| 3,748,810 | 7/1973 | Mattingly | 52/742 |

FOREIGN PATENT DOCUMENTS

| | | | |
|---|---|---|---|
| 1544932 | 11/1967 | France | 52/169.8 |

*Primary Examiner*—John E. Murtagh

*Assistant Examiner*—Mark J. Sofia

*Attorney, Agent, or Firm*—Stonebraker, Shepard & Stephens

[57] ABSTRACT

A swimming pool wall 10 is made with a vertical resin wall 15 and an outer resin form 16 spaced from and parallel with each other, and concrete is poured in the space between and formed over the bottom of the pool. Both resin wall 15 and form 16 are formed as continuous strips of resin material. Vertical C-shaped channels 26 are adhered periodically to the outside surface of resin wall 15, and T-head stakes 25 interlocking with channels 26 are driven into the ground to support wall 15. Each stake 25 has a horizontal arm 30 that extends outward, and vertical braces 31 extend upward from the outer ends of arms 30. Form 16 is upheld by arms 30 and vertically supported against braces 31, making form 16 parallel with wall 15 and uniformly spaced outward from wall 15. Latches 35 extend from stakes 25 to braces 31 to support the braces and hold form 16 in place. Bars 32 are driven vertically into the ground between braces 31 and adjacent the inside surface of form 16 to prevent bulges. Along the bottom edge of resin wall 15, a horizontal strip 40 is screwed to stakes 25; and a movable resin coping nose 20 is mounted on top of wall 15. Concrete is poured to fill the space between the wall and the form and also to form the bottom of the pool.

15 Claims, 3 Drawing Figures

CONCRETE AND RESIN SWIMMING POOL WALL

BACKGROUND

A multitude of possibilities have been tried for swimming pool walls; and no solution is yet optimum, especially in northern regions where ice damage occurs. A pool wall must be sturdy, watertight, durable, and easy to maintain; and yet price competition requires use of inexpensive materials. Also, pools are often installed by unskilled labor, so that installation has to be relatively simple to produce reliable results with minimal skills.

My invention considers all these requirements and improves on in-ground pools having concrete walls. It includes a simple and effective form system for making the concrete wall uniformly thick and strong, and the form structure and materials cooperate in many ways to insure easy installation and a sturdy and durable wall. The concrete preferably extends throughout the pool bottom where it serves as a form for a resin inner wall joined to a resin side wall included in the form system to make a tough and integral resin interior supported by surrounding concrete. The wall is also made to accommodate movements from ice pressure so that the wall survives well in northern climates.

SUMMARY OF THE INVENTION

My invention uses a support system to uphold a resin inner wall and an outer resin form that are spaced apart to receive poured concrete that also extends over the pool bottom. Both the inner wall and the outer form are continuous strips of resin material. Vertical and evenly spaced C-shaped channels are adhered to the outer surface of the resin wall to interlock with T-head stakes driven into the ground for supporting the wall. Braces extend vertically upward from the outer ends of horizontal arms secured to the stakes at the bottom of the resin wall. The form is upheld by the arms and supported against the braces so the form is evenly spaced from the resin wall. Latches extend through the form to connect the stakes and braces, and bars are driven vertically into the ground between the braces and adjacent the inside of the form to maintain a uniform space thickness when the concrete is poured. A horizontal strip at the bottom inside surface of the resin wall is screwed to the stakes through the wall. A resin coping nose mounted on top of the resin wall is made movable to help prevent damage to the pool from frost. Concrete can then be poured in the pool wall and bottom, an inner resin wall can be formed on the concrete bottom, and a separate concrete deck can be formed against the coping nose.

DRAWINGS

DETAILED DESCRIPTION

Figure 1:
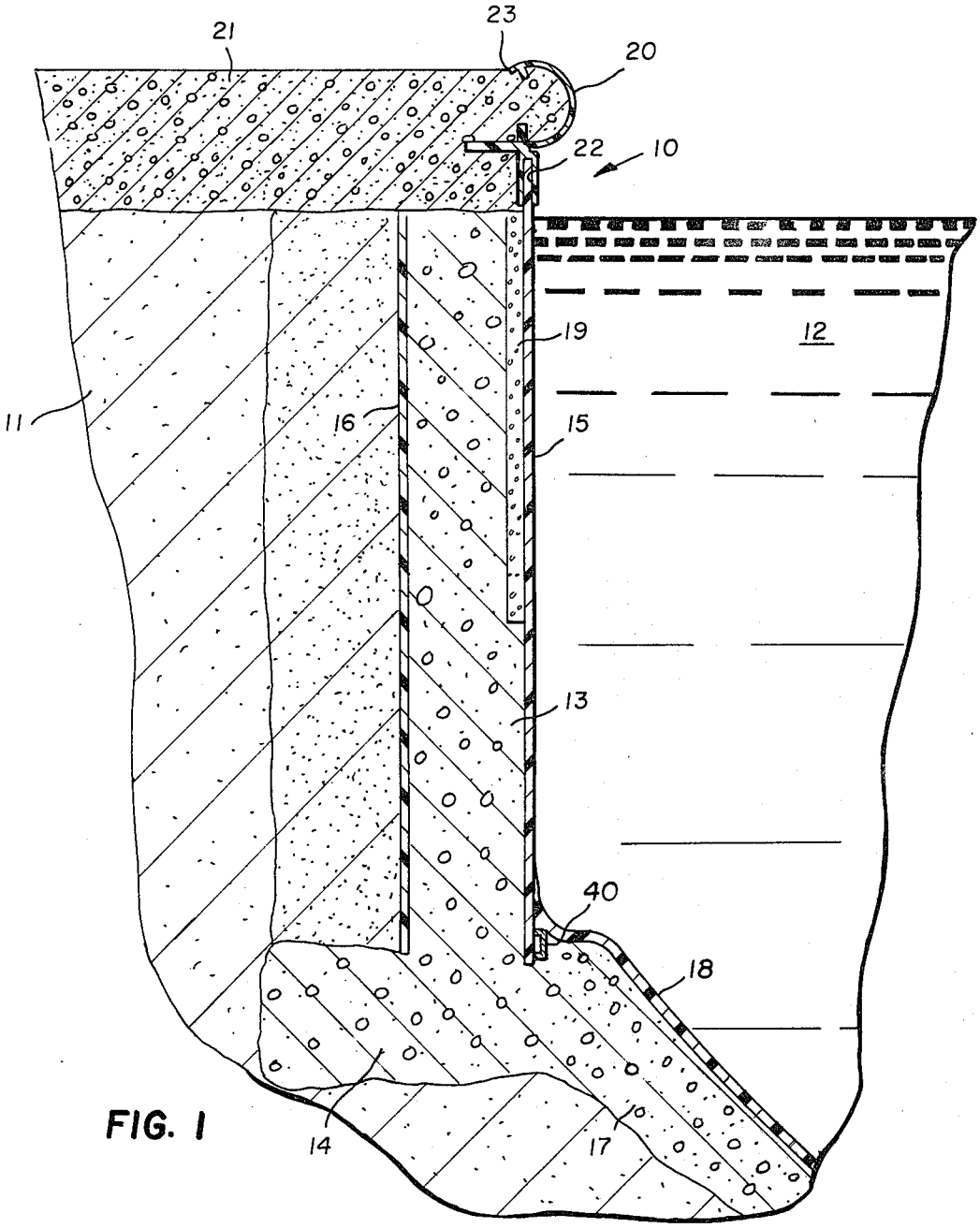
FIG. 1 is a fragmentary cross-sectional view of a preferred embodiment of a pool wall made according to my invention.

Pool wall 10 as shown in FIG. 1 is formed in ground 11 to contain water 12. Its inside surface is a continuous strip of resin material 15, and its outer surface is a resin form 16. Concrete 13 fills the space between resin wall 15 and form 16, and concrete extends throughout an enlarged footing 14 under wall 10 and a pool bottom 17 resting on earth 11. A resin bottom wall 18 covers pool bottom 17 and joins with resin side wall 15. Foamed resin panels 19 provide cushioning and insulation around the outside of the upper region of resin wall 15.

A resin coping nose 20 slidably fits on the top of resin wall 15, and a concrete deck 21 is formed against coping nose 20 to rest on top of wall 10 and extend over the adjoining earth 11. This leaves deck 21 free to move slightly relative to wall 10 without damaging the pool.

Resin wall 15 is preferably formed as a fiber glass reinforced polyester resin strip that is continuous around the perimeter of the pool. Such a material is commercially available in long lengths and is strong, durable, and attractive for the inner surface of a pool. A long strip of fiber glass reinforced resin 15 is cut to the right length to form an overlap joint that is secured with adhesives, bracing materials, and screws or bolts. Wall 15 then forms a continuous interior surface around the upper three and one-half feet of pool wall 10. It can bend around suitable radii at corners and steps or be formed with corner joints, and it can be arranged in an infinite variety of shapes.

Concrete 13 is conventional and provides structural strength and durability in wall 10. It also forms footing 14 and covers pool bottom 17, which can be relatively thin to serve as a mold for fiber glass mats coated with polyester resin to form pool bottom 18 adjoining resin wall 15. Much of the strength and watertight integrity of the pool occurs from wall 15 and bottom 18, with concrete 13 and 17 serving as a structural support and barrier layer between the resin wall and the surrounding earth.

Foamed resin panels 19 are preferably styrofoam or some other low cost foamed resin material that cushions and insulates around the upper region of wall 15. Panels 19 prevent stones in concrete 13 from denting and pressing into or through wall 15, and panels 19 are compressible enough to accommodate slight relative frost movement of concrete 13 and surrounding earth 11 without damaging wall 15. Panels or slabs 19 are preferably one-half to one inch thick, which is sufficient to add some thermal insulation around the upper perimeter of the pool. Panels 19 also reduce the amount of concrete required.

Coping nose 20 is preferably formed as a resin extrusion having the conventional rounded shape and a downwardly opening slot 22 that has a firm but movable grip on the upper edge of wall 15. This allows coping nose 20 to raise and lower slightly relative to wall 15 without damaging the pool. The curve of coping nose 20 also extends below the horizontal at its upper end for a neat joint with concrete deck 21, which is poured after concrete 13 has set in wall 10 so that deck 21 can move slightly relative to pool wall 10. This allows frost to heave or settle deck 21 without harming the pool.

Form 16 is a continuous strip of resin material that need not be reinforced with glass fibers but is sturdy enough to contain poured concrete. It is supported as explained below and wrapped around pool wall 10 in a position uniformly spaced outward from resin wall 15 to form concrete 13 with a uniform thickness of about six inches.

Figure 2:
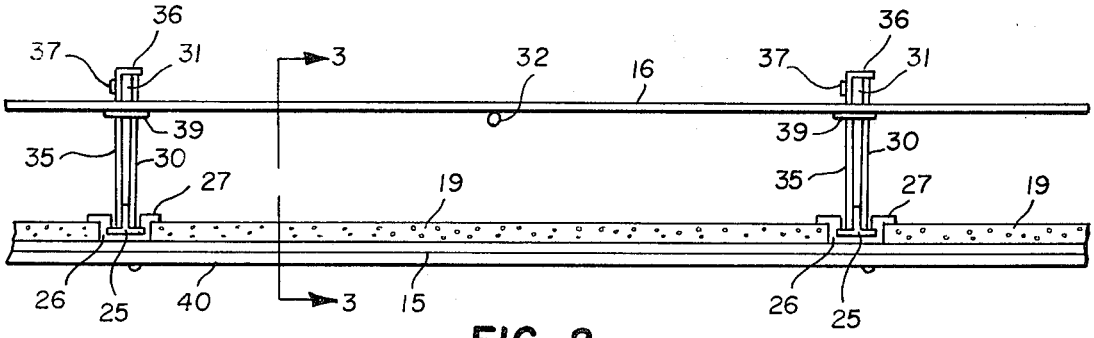
FIG. 2 is a fragmentary plan view of a form structure for the wall of FIG. 1.
Figure 3:
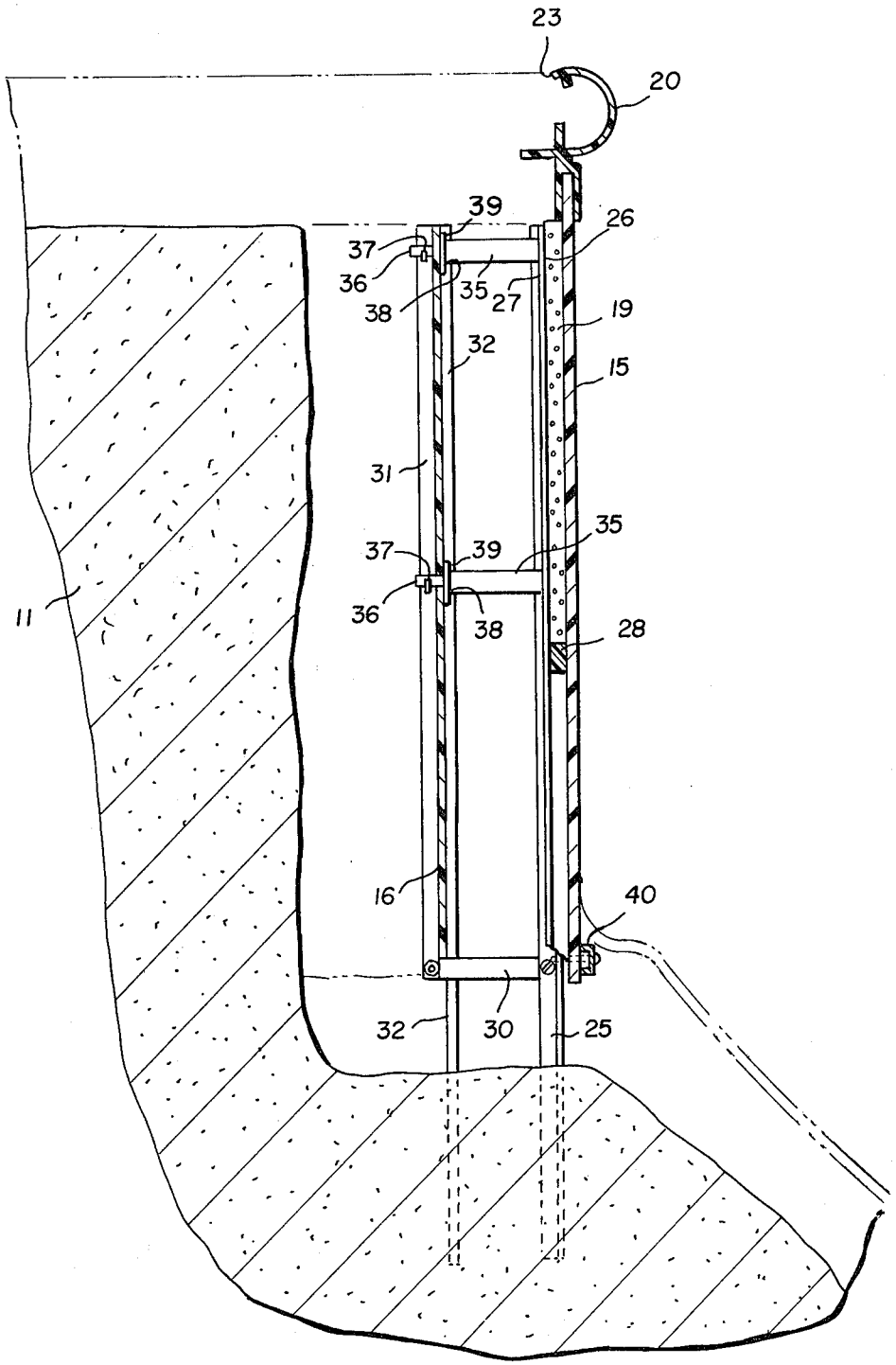
FIG. 3 is a fragmentary side elevational view of the form structure of FIG. 2 with a coping nose added.

Vertically oriented C-shaped channels 26 are periodically adhered to the outside surface of resin wall 15 to support interlocking T-head stakes 25 as best shown in FIGS. 2 and 3. Channels 26 are preferably extruded of resin material with a C-shaped channel sized to interlock with the T-heads of stakes 25. A suitable adhesive is preferred for securing channels 26 to resin wall 15 at periodic intervals of preferably 16 inches. Resin strip 15 is available in rolls and can be unrolled on a table for adhering channels 26 in place to extend from the bottom to near the top of wall 15.

Channels 26 also preferably have flanges 27 extending outward from the C-shape to retain the edges of foamed resin panels 19. These are cut at suitable lengths to slide vertically downward between the flanges 27 of adjacent channels 26. Blocks or other abutments 28 secured to wall 15 to support the lower edges of panels 19.

Horizontal arms 30 extend outward from each stake 25 in the region of the bottom of resin wall 15, and each horizontal arm 30 supports a vertical brace 31 extending upward from the outer end of arm 30 to be approximately parallel with stake 25. Braces 31 support resin form 16 which is upheld by horizontal arm 30. Stakes 25, horizontal arms 30, and braces 31 are preferably formed of metallic strips such as aluminum and are preferably rivoted together, although other connections and materials can be used.

At least one latch and preferably a pair of latches 35 connect between stakes 25 and braces 31 to hold the stakes and braces parallel and extend through and bond to the concrete between them. Latches 35 are also preferably formed of metallic strips fastened to stakes 25 and extending outward as illustrated. Latches 35 are preferably cut to have reduced size or pointed free ends 36 and are preferably mounted to be pivotably movable on stakes 25. latches 35 can then be lowered while form 16 is positioned inside braces 31, and free ends 36 can be raised and manually pressed through form 16 and bent to latch around braces 31 as illustrated. Projections 37 struck out from braces 31 provide a supporting rest for the free ends 36 of latches 35, and shoulders 38 on latches 35 support a washer or slotted piece 39 positioned to hold form 16 against brace 31.

A channel or strip 40 preferably formed of aluminum is positioned around the lower edge of resin wall 15 and secured in place preferably by self-tapping screws driven through channel 40, wall 15, and the T-head of stakes 25. This connects all the stakes 25 to a common electrical conductor for grounding purposes and strengthens and braces wall 15 in a desired shape around its lower edge. Coping nose 20 fitted around the upper edge of wall 15 also strengthens and holds wall 15 in the desired shape. Strip 40, like coping nose 20, is preferably flexible enough to bend around curves and corners.

To form a pool wall according to my invention, the necessary materials and tools are collected at the site and the excavation is dug. Then resin wall 15, with its attached channels 26, is positioned around an excavated ledge formed to support footing 14 under pool wall 10; and wall 15 is held above the earth by spacers such as cement blocks. Stakes 25, with their attached arms 30 and braces 31, are slid down through C channels 26 and driven into the earth below to support wall 15 vertically above the excavated ledge. Wall 15 is properly leveled and its ends are overlapped and joined at a suitable location in the pool. Form 16 is positioned against braces 31 and held by latches 35, which are pressed through form 16 and bent around braces 31. Foamed resin panels 19 are slid down between the flanges 27 of adjacent channels 16 to abut against bottom blocks 28. Strip 40 is fastened on, and coping nose 20 is pressed onto the top of wall 15.

Stakes 32, preferably formed of rebar rods, are driven into the ground between braces 31 and adjacent the inside surface of form 16 so that concrete poured against one region of form 16 cannot pull form 16 inward in an adjacent region and leave the concrete with thick and thin regions. This keeps the concrete wall to a uniform thickness of about six inches and adds to the strength of the wall.

Then concrete is poured into the space between wall 15 and form 16 and spreads out at the bottom to form an enlarged footing 14. The poured concrete extends to the top of wall 10 all around the pool perimeter, and the concrete for pool bottom 17 is also poured and smoothed to form a mold and support for resin bottom 18.

After the concrete 13, 14, and 17 has set, fiber glass and resin bottom 8 is formed on concrete 17 to join wall 15, earth 11 is backfilled against form 16 and braces 31. Then concrete deck 21 is formed against coping nose 20. Other operations such as steps, skimmers, diving boards, slides, ladders, drains, lights, chlorine dispensers, islands, and plumbing are incorporated into the pool as required while the word proceeds.

The result is a sturdy concrete pool having a strong, durable, and attractive inner wall of fiber glass reinforced resin. Its installation is convenient and simple; the materials are inexpensive but effective; and the result is not only strong, reliable, and easy to maintain, but also designed tto withstand movement from frost and ice.

I claim:

1. A swimming pool wall comprising:

a. a vertical resin wall formed of a continuous strip of resin material located at the inside surface of said pool wall;

b. vertically oriented C-shaped channels periodically adhered to the outside surface of said resin wall;

c. T-head stakes interlocked with said channels and driven into ground to support said resin wall;

d. horizontal arms extending outward from said stakes in the region of the bottom of said resin wall;

e. braces extending vertically upward from the outer ends of said arms to be approximately parallel with said stakes and spaced from said stakes;

f. a continuous strip of resin form upheld by said arms and supported vertically against said braces to be approximately parallel with and spaced from said resin wall;

g. latches extending from said stakes and through said form to latch onto and uphold said braces;

h. bars driven vertically into ground and positioned adjacent the inside of said form between said braces;

i. a horizontal strip positioned around the inside surface of the bottom region of said resin wall and screwed to said stakes through said resin wall;

j. a resin coping nose slidably mounted on the top region of said resin wall; and k. concrete filling the space spanned by said latches and extending continuously along said pool wall between said resin wall and said form and resting on ground below said bottom region of said resin wall.

2. The swimming pool wall of claim 1 wherein said strip screwed to said stakes is a metallic channel.

3. The swimming pool wall of claim 1 wherein said coping nose is formed of resin material and has a vertical slot for a snug sliding fit on said top region of said resin wall.

4. The swimming pool wall of claim 3 including a concrete deck formed to join said coping nose and rest movably on top of said pool wall and the ground outside said form.

5. The swimming pool wall of claim 1 wherein the bottom of said pool is formed of concrete and lined with glass fiber reinforced resin material joining said resin wall.

6. The swimming pool wall of claim 1 including panels of foamed resin material positioned on the outside of said resin wall between said channels around an upper region of said resin wall, and wherein said channels have flanges that retain said foamed resin panels.

7. The swimming pool wall of claim 6 including abutments adhered to said resin wall to support the bottoms of said foamed resin panels.

8. The swimming pool wall of claim 1 wherein said latches are secured to said stakes, have free ends that can penetrate said form and bend over said braces to latch, and have shoulder elements that hold said form against said braces.

9. The swimming pool wall of claim 8 wherein said braces have struck out projections that receive said free ends of said latches.

10. The swimming pool wall of claim 8 including a plurality of said latches secured to each of said stakes and latched to each of said braces.

11. The swimming pool wall of claim 8 wherein said shoulder elements are flat pieces slotted to receive said free ends of said latches.

12. The swimming pool wall of claim 1 wherein the bottom of said pool is formed of concrete and lined with glass fiber reinforced resin material joining said resin wall, and wherein said coping nose is formed of resin material and has a vertical slot for a snug sliding fit on said top region of said resin wall.

13. The swimming pool wall of claim 12 including panels of foamed resin material positioned on the outside of said resin wall between said channels around an upper region of said resin wall, and wherein said channels have flanges that retain said foamed resin panels.

14. The swimming pool wall of claim 13 wherein said latches are secured to said stakes, have free ends that can penetrate said form and bend over said braces to latch, and have shoulder elements that hold said form against said braces.

15. The swimming pool wall of claim 14 including a concrete deck formed to join said coping nose and rest movably on top of said pool wall and the ground outside said form.

* * * * *